United States Patent [19]

Yoshimura

[11] Patent Number: 4,831,822

[45] Date of Patent: May 23, 1989

[54] EXHAUST SYSTEM FOR MARINE ENGINE

[75] Inventor: Tsuyoshi Yoshimura, Hamamatsu, Japan

[73] Assignee: Sanshin Kogyo Kabushiki Kaisha, Hamamatsu, Japan

[21] Appl. No.: 204,686

[22] Filed: Jun. 9, 1988

[30] Foreign Application Priority Data

Jun. 10, 1987 [JP] Japan ..... 62-143398

[51] Int. Cl.[4] ..... B63H 21/32

[52] U.S. Cl. ..... 60/310; 60/311; 440/89

[58] Field of Search ..... 60/310, 311, 309; 440/89

[56] References Cited

U.S. PATENT DOCUMENTS

| | | | |
|---|---|---|---|
| 3,759,041 | 9/1973 | North et al. . | |
| 4,504,238 | 3/1985 | Neisen | 440/89 |
| 4,687,450 | 8/1987 | Bland et al. . | |
| 4,734,071 | 3/1988 | Zemlicka et al. . | |

*Primary Examiner*—Douglas Hart

*Attorney, Agent, or Firm*—Ernest A. Beutler

[57] ABSTRACT

An exhaust system for a marine propulsion unit having an exhaust conduit into which the exhaust gases and engine coolant are discharged. The exhaust conduit has a separator portion that is affected to separate the coolant from the exhust gases under high speed running conditions so as to achieve maximum power output through a reduction in back pressure but no substantially no separation is provided at low speeds so that silencing will not be adversely affected.

4 Claims, 6 Drawing Sheets

EXHAUST SYSTEM FOR MARINE ENGINE

BACKGROUND OF THE INVENTION

This invention relates to an exhaust system for marine engines in more particularly to an improved exhaust system that does not adversely affect high range performance and, at the same time, provides good silencing at low engine speeds.

It is well known that water cooled marine engines, be they either inboard drives or outboard drives, including outboard motors, generally mix the engine coolant discharged from the cooling jacket with the exhaust gases prior to discharge to the atmosphere either directly or back through the body of water in which the watercraft is operating. With regard to such systems, the introduction of the coolant into the exhaust system simplifies the plumbing associated with the engine and also provides some significant silencing and cooling of the exhaust gases. However, the introduction of the water into the exhaust system can give rise to back pressure in the exhaust system that adversely affects the high range performance.

Therefore, systems have been proposed which include water separators which will separate the engine coolant from the exhaust gases and which discharge the coolant through a separate discharge from the exhaust discharge. The systems provide either centrifugal or gravitational separation and provide this degree of separation independent of engine speed. These arrangements, therefore, have a tendency to cause substantial noise through exhaust gas discharge through the water outlet under slow speed running which is not satisfactory.

It is, therefore, a principle object of this invention to provide an exhaust system for a marine engine wherein silencing is achieved at low speeds and wherein it is insured that good water separation is achieved at high speeds so as to reduce back pressure and improve engine performance.

It is a further object of this invention to provide an improved exhaust system for a marine engine wherein water separation is achieved primarily only at the higher engine speeds so as to avoid noise at low speeds and improve high speed performance.

SUMMARY OF THE INVENTION

This invention is adapted to be embodied in an exhaust system for a marine propulsion device comprised of an internal combustion engine that includes a cooling jacket having an engine cooling outlet and an exhaust system having engine exhaust outlet. An exhaust conduit is incorporated for conveying exhaust gases and coolant from the engine. The exhaust conduit is in communcation with the engine exhaust outlet and the engine coolant outlet for receiving engine exhaust gases and engine coolant. The exhaust conduit also provides a coolant discharge and a separate exhaust discharge. In accordance with the invention, the exhaust conduit has a portion upstream of the coolant discharge that is configured to redirect the flow of coolant toward the coolant discharge at high speeds for separating coolant from the exhaust gases only under this running condition and for providing coolant flow to the exhaust discharge at low running speeds.

DETAILED DESCRIPTION OF THE PREFERRED EMBODIMENTS

Figure 1:
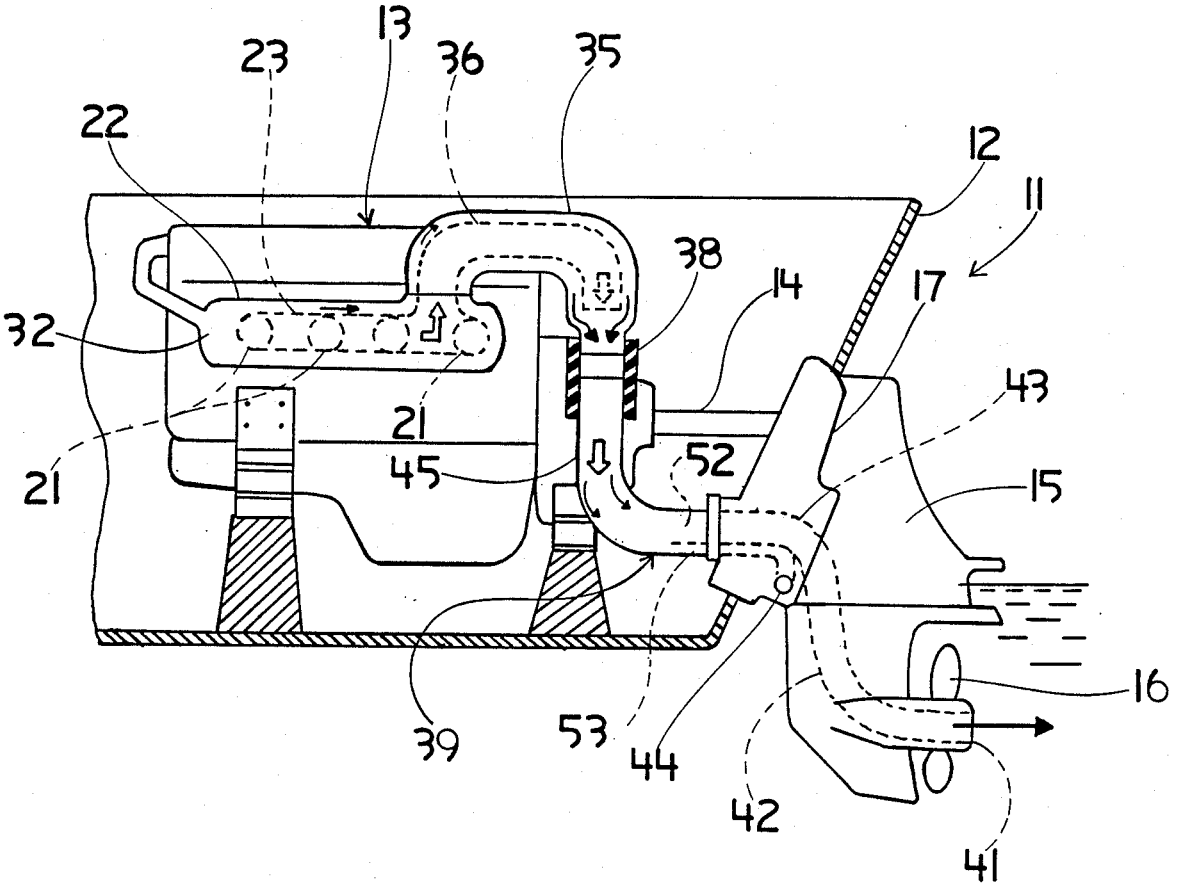
FIG. 1 is a side elevational view, with portions show and section and other portions broken away, of a watercraft incorporating an exhaust system constructed in accordance with an embodiment of the invention.

Referring now in detail to the drawings and initially to FIG. 1, a watercraft constructed in accordance with an embodiment of the invention is shown partially and is identified generally by the reference numeral 11. The watercraft 11 is comprised of a hull 12 having a rearwardly position engine compartment in which an internal combustion engine 13 is positioned. The engine 13 may be of any known type but is of the water cooled, internal combustion type. As depicted, the engine 13 is of the four cylinder, inline type operating on the four stroke principal.

The engine 13 has an output shaft 14 that is coupled to an outboard drive unit, indicated generally by the reference numeral 15 and which contains a transmission of mechanism (not shown) for driving a propeller 16 in a known manner. The outboard drive 15 includes a gimbal housing 17 that is fixed to the transom of the watercraft 12 and from which a stern drive unit is supported for steering and tilt and trim operation in a known manner.

Figure 2:
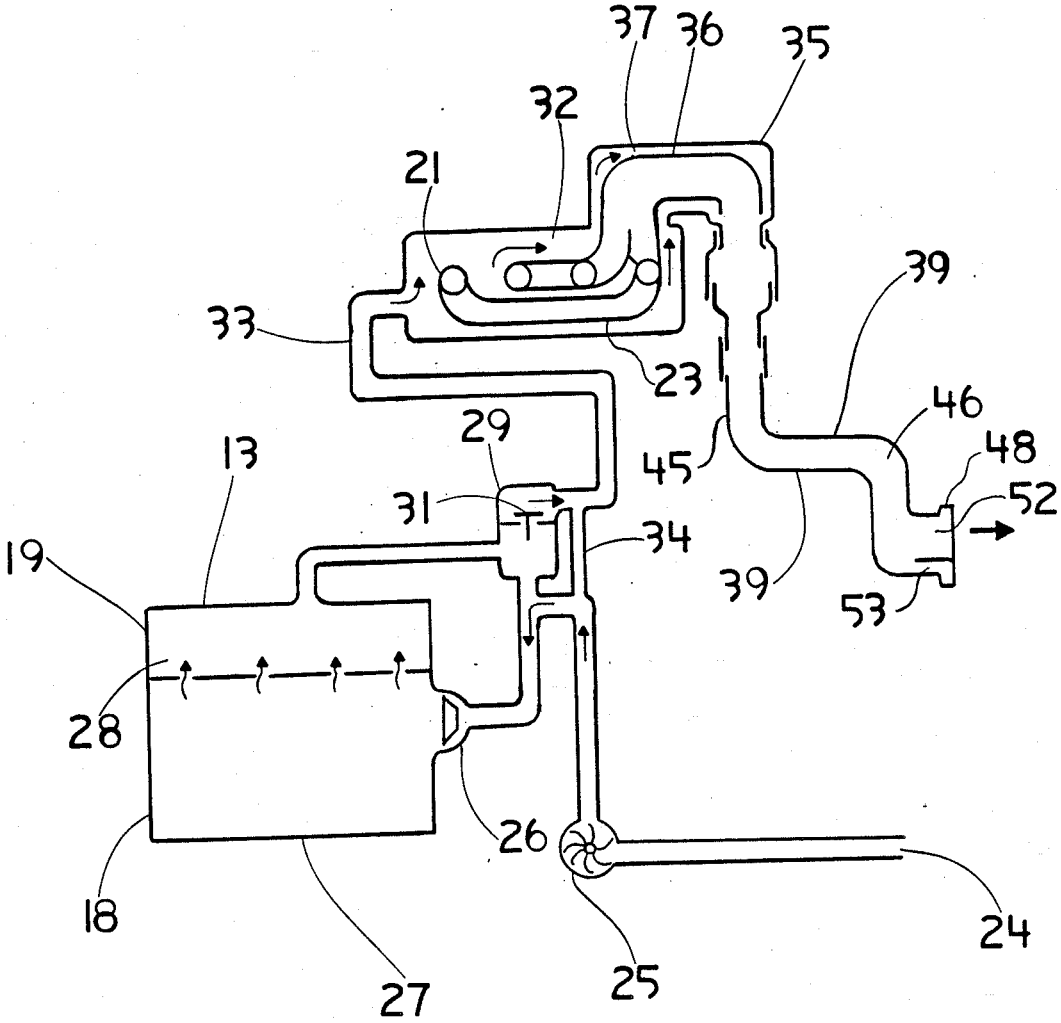
FIG. 2 is a schematic view showing the engine coolant and exhaust system.

Referring now additionally to FIG. 2, the engine 13 is generally comprised of a cylinder block 18 and cylinder head 19. The cylinder head 19 is provided with a plurality of exhaust ports 21 from which the exhaust gases of the engine cylinders are discharged to a manifold, indicated generally by the reference numeral 22 and which includes an exhaust collector section 23 that collects the exhaust gases discharged from the exhaust ports 21.

As may be best seen in FIG. 2, the cooling system for the engine 13 includes water inlet 24 which may be formed suitably in the outboard driveunit 15 at a location which is below the level of water in which the watercraft 12 operates under all running conditions. A coolant pump 25 is contained within the outboard drive unit 15 and is driven by the driveshaft thereof (not shown) in a known manner. Coolant is delivered from the pump 25 to an engine coolant pump 26 that is driven by the engine output shaft in a known manner. This coolant is then circulated through the cooling jacket of the engine which comprises a cylinder block cooling jacket 27 and a cylinder head cooling jacket 28. From there the coolant is discharged from the engine 13 in to a thermostat housing 29 in which a thermostatic valve element 31 is provided. When the engine is operating at full operating temperature, the thermostatic valve element 31 will be opened and coolant is discharged into a exhaust manifold cooling jacket 32 which surrounds the collector section 23 for effecting cooling of the exhaust pipes. A conduit 33 extends from the thermostatic valve housing 29 to the manifold cooling jacket 32 for this purpose.

When the engine is cold and the thermostatic valve element 31 is closed, coolant delivered by the coolant pump 25 will merely be circulated through the exhaust cooling jacket 32 through a bypass conduit 34.

An elbow section 35 is provided which communicates at its inlet end with the manifold 22 and which has an internal passageway 36 that receives the exhaust gases from the collector section 23. There is also provided a cooling jacket 37 which extends around the passageway 36 to provide additional cooling for the exhaust gases. At its discharge end, the elbow 35 mixes both the exhaust gases and the coolant before discharge into a flexible conduit 38. This mixing cools the exhaust gases and also will silence them.

The portion of the exhaust and cooling system and overall watercraft construction as thus far described may be considered to be conventional. Because of this, it is believed that those skilled in the art will require no further description of this construction.

In accordance with the invention, exhaust gases are discharged from the elbow 35 along with the water to an exhaust conduit, indicated generally by the reference numeral 39 and constructed in accordance with the invention. The conduit 39 is designed so as to provide separation of the coolant from the exhaust gases for discharge of the coolant back to the body of water in which the watercraft is operating through a separate water discharge under high speed running so as to reduce exhaust back pressure. However, under slow speed running, the water and coolant are discharged together through an underwater exhaust gas discharge 41 which may be of the through the hub type and which includes a passageway 42 in the lower unit of the outboard drive section 15. A flexible conduit 43 delivers the exhaust gases to the lower unit discharge passage 42 in a known manner.

Figure 3:
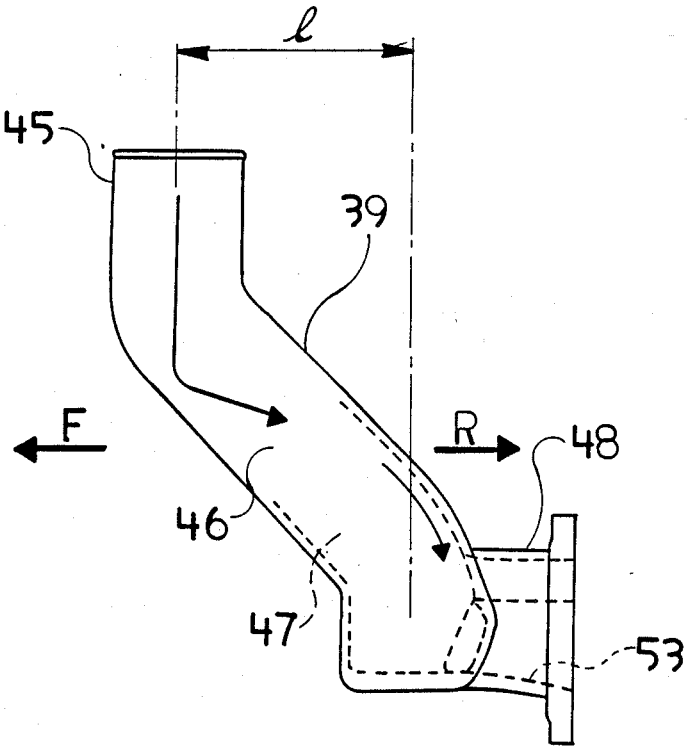
FIG. 3 is a side elevational view, on an enlarged scale, of a component of the exhaust system.
Figure 4:
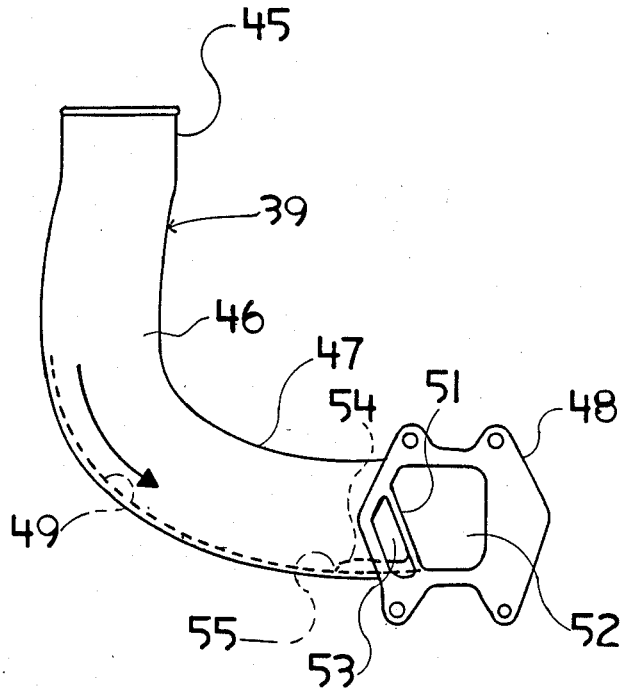
FIG. 4 is a rear elevational view of the component.
Figure 5:
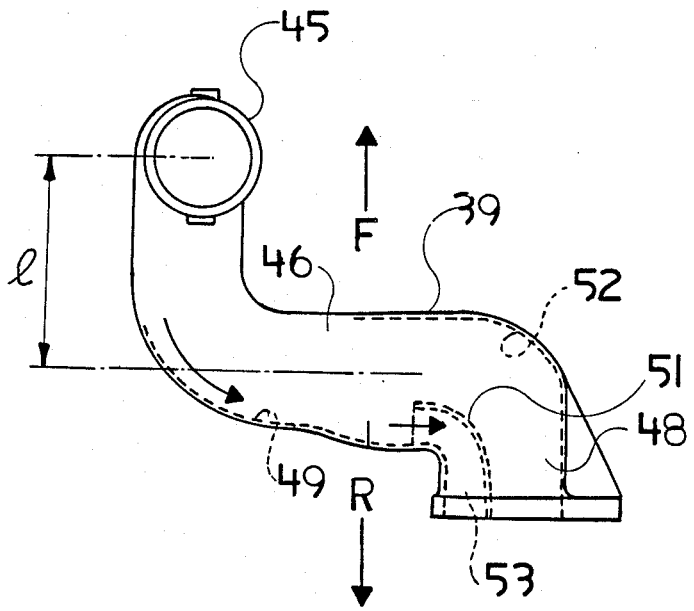
FIG. 5 is a top plan view of this component.

The exhaust conduit 39, the construction which is shown in most detail in FIG. 3 through 5, is configured so as to substantially preclude any separation of the coolant from the exhaust gases when running at low speeds so that both the coolant and the exhaust gases will be discharged together through the underwater discharge 41 at this running condition. However, as the engine speed increases, there is provided a water separation function by the conduit 39 so that the coolant will be extracted from the exhaust gases and discharged through a coolant discharge passage 44 (FIG. 1) formed in the outboard drive section 15. By so separating the water from the exhaust gases, there will be a substantial reduction in back pressure under this running condition and hence there is not a loss of engine performance. However, since no water separation is accomplished at low speeds and the exhaust gases are mixed with the water, there will be good silencing at low speeds.

Referring primarily to FIG. 3 through 5, the exhaust conduit 39 includes a tubular inlet section 45 to which the flexible conduit 38 is connected so that water and exhaust gases will be delivered from the elbow 35 to the exhaust conduit 39. In the illustrated embodiment, the inlet section 45 in a generally vertically downwardly extending direction. At the end of the inlet section 45, there is provided a rearwardly and inwardly curved section 46 that functions as a separator, in a manner to be described. The section 46 is inclined, as has been noted, to the rearward section and terminates at its lower end in a curved portion 47 that turns inwardly toward the center of the watercraft and which terminates in a discharge flange 48 which, in turn, extends in a rearward direction. It should be noted that the section 47 commences at a distance 1 rearwardly of the inlet to the section 45 as a result of the rearward incline of the separator section 46.

It will be noted that the separator section 46 is defined in part by a wall 49 that is disposed to be impinged upon by the exhaust gases and water, under certain running conditions. At the end of the wall 49 and in the discharge flange 48 there is provided a separating or dividing wall 51 that divides an outlet opening into an exhaust gas discharge portion 52 and a water discharge portion 53. The exhaust gas discharge portion 52 cooperates with the flexible conduit 43 so as to deliver the exhaust gases to the lower unit. The water discharge conduit 53, on the other hand, cooperates with the water discharge 44 for discharge of the water through this discharge.

A portion of the wall 51 at the lower part of the water passageway 53 is formed with a raised projection 54 that extends to the end of the wall 51 from a rounded forward portion 55 so as to direct the water and confine it in the passageway 53.

Under low speed running, the exhaust gas pressures are relatively low and the water and exhaust gases will flow generally through the conduit 39 and, as has been noted, substantially no separation will result and all of the coolant and exhaust gases will be discharged to the exhaust discharge 53 for discharge through the underwater discharge 41. However, as the speed of the engine increases, the pressure of the exhaust gases will force the water against the wall 49 of the separator section 46 and the heavier water will then flow along the surface of this wall and be trapped by the wall 51 for discharge through the water discharge 53 and discharge opening 44 in the gimbal housing 17. As a result, the separation of the water from the exhaust gases will reduce back pressure and there will be no loss of performance under high speed operation.

Figure 6:
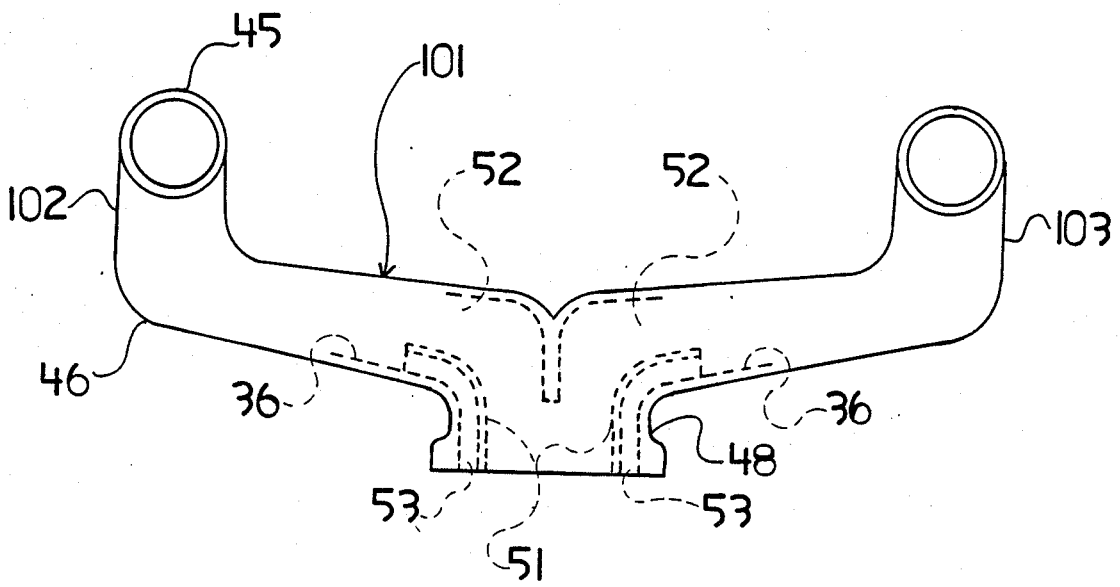
FIG. 6 is a top plan view, in part similar to FIG. 5, showing another embodiment of the invention.
Figure 7:
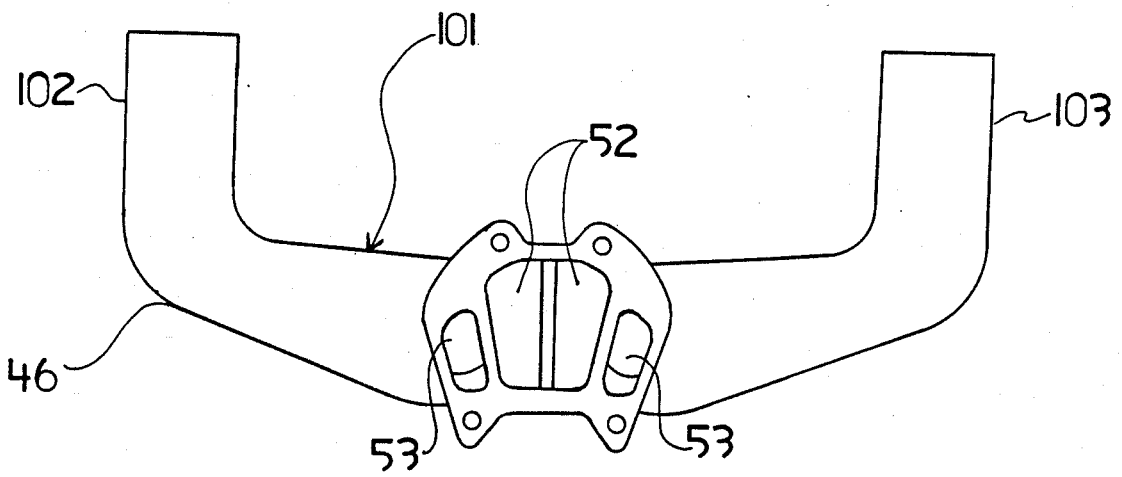
FIG. 7 is a rear elevational view of this embodiment.

The embodiment thus far described particularly lends itself for application to inline engines. However, it is possible to adapt this principle to the type engines having separate exhaust manifolds for each bank of the V. FIG. 6 and 7 show an exhaust conduit 101 that is particularly adapted for such application. The conduit 101 has a pair of branch sections 102 and 103 each of which is configured as the conduit 39 of the previously described embodiment. That is, each branch 102 and 103 has a generally straight inlet section 45 a separator section 46 that curves downwardly, rearwardly and inwardly and which terminates in a forwardly directed outlet flange 48. The outlet flange 48 is separated by a dividing wall 51 into the water discharge 53 and exhaust discharges 52. In such an application, the exhaust discharges 52 from a common opening at the outlet flange 48 of the conduit 101. The method of separation is the same as the previously described embodiment and, for that reason, further discussion is not believed to be required.

From the foregoing description, it should be readily apparent that several embodiments of the invention have been illustrated and described and each of which provide good treatment for the exhaust gases and coolant of a marine engine. The exhaust gases and coolant are mixed together under low speed running and discharged through a common opening to provide effective silencing. However, as the speed of the engine increases, the dynamic affect of the separator will cause the water to be separated from exhaust gases and discharged through a separate discharge so as to reduce back pressure. Although two embodiments of the invention ahs been illustrated and described, various changes and modifcations may be made without departing from the spirit and scope of the invention as defined by the appended claim.

I claim:

1. In an exhaust system for a marine propulsion device comprising an internal combustion engine comprised of a cooling jacket having an engine coolant outlet and an exhaust system having an engine exhaust outlet, an exhaust conduit for conveying exhaust gases and coolant from said engine, said exhaust conduit being in communcation with said engine exhaust outlet and said engine coolant outlet for receiving engine exhaust gases and engine coolant, said exhaust conduit providing a coolant discharge and a separate exhaust discharge, the improvement comprising said exhaust conduit having a portion upstream of said coolant discharge configured to redirect the flow of coolant towards said coolant discharge at high speeds for separating coolant from said exhaust gases only under this running condition and for permitting coolant to flow through said exhaust discharge at low running speeds.

2. In an exhaust system for a marine propulsion device as set forth in claim 1 wherein the exhaust conduit portion is configured to present a wall facing the exhaust gases and coolant and adapted to be impinged upon by the coolant only when the exhaust gas pressure indicates high speed running conditions.

3. In an exhaust system for a marine propulsion device as set forth in claim 1 wherein the exhaust conduit portion is inclined downwardly and rearwardly.

4. In an exhaust system for a marine propulsion device as set forth in claim 3 wherein the exhaust conduit portion is configured to present a wall facing the exhaust gases and coolant and adapted to be impinged upon by the coolant only when the exhaust gas pressure indicates high speed running conditions.

* * * * *